United States Patent [19]

Ekholm

[11] Patent Number: 4,838,385

[45] Date of Patent: Jun. 13, 1989

[54] METHOD FOR COORDINATING ELEVATOR GROUP TRAFFIC

[75] Inventor: Ralf Ekholm, Helsinki, Finland

[73] Assignee: Kone Elevator GmbH, Switzerland

[21] Appl. No.: 100,448

[22] Filed: Sep. 24, 1987

[30] Foreign Application Priority Data

Sep. 24, 1986 [FI] Finland ..... 863861

[51] Int. Cl.[4] ..... B66B 1/02

[52] U.S. Cl. ..... 187/101

[58] Field of Search ..... 187/101, 124, 125

[56] References Cited

U.S. PATENT DOCUMENTS

| | | | |
|---|---|---|---|
| 3,467,223 | 9/1969 | Suozzo et al. | 187/101 |
| 3,561,569 | 2/1971 | Suozzo et al. | 187/101 |
| 4,499,973 | 2/1985 | De Lorenzi et al. | 187/125 |

*Primary Examiner*—William M. Shoop, Jr.
*Assistant Examiner*—W. E. Duncanson, Jr.
*Attorney, Agent, or Firm*—Birch, Stewart, Kolasch & Birch

[57] ABSTRACT

In a method for coordinating elevator group traffic in a building with one or more change levels constituting an end station for elevator groups operating above and below the change level, and in order to reduce waiting times in tall buildings, the control of at least some of the elevator groups operating on opposite sides of the change level is subordinated to a centralized control algorithm which, depending on the traffic condition, alters the control parameters for the elevator groups in such manner that, when the main direction of traffic is upwards, in order to serve the passengers of the elevators arriving from one side of the change level, either the elevators operating on the other side are caused to arrive more quickly to the change level to minimize the waiting time for the passengers arriving from the opposite side, and/or the departures of the elevators which have stopped at the change level are retarded to allow the passengers arriving from the other side to get on board, and that when the main direction of traffic is downwards, in order to serve the passengers of the elevators arriving from one side of the change level, either the elevators are caused to arrive quicker to the change level and/or the elevators on the other side are kept waiting to allow the arriving passengers to catch them.

7 Claims, 2 Drawing Sheets

METHOD FOR COORDINATING ELEVATOR GROUP TRAFFIC

BACKGROUND OF THE INVENTION

The present invention concerns a method for coordinating elevator group traffic in buildings with one or more change levels constituting one of the end stations for the elevator groups operating above and below the change level.

In tall buildings, especially in skyscrapers housing office premises, the elevator groups are usually arranged in zones so that the elevators in a given zone only serve calls within that zone, the zones being arranged one above the other, which means that it is only possible to reach a given floor by using an elevator that operates within the zone concerned. The zones not served by a given elevator and passed without stopping are called express zones. The purpose of this arrangement is to maximize the transportation capacity of the elevator system during the morning and afternoon rush hours. The elevator groups in the different zones are usually controlled by a conventional automatic and independent group control system, such as those presented e.g. in U.S. Pat. Nos. 4,567,560 and 4,582,173.

Regarding elevator traffic arrangements, very tall buildings with more than 50 floors are preferably divided into two or more sections in the vertical direction. The lower section up to the change level ("sky lobby") is served by an elevator system divided into zones as described above, and the upper section by another such system. The sky lobby is reached directly from the ground floor by means of shuttle elevators. In this way a larger transportation capacity is achieved for the elevator shaft volume available, i.e. the ratio of the horizontal sectional area of the building to the space required by the elevators is better. However, this system has the drawback that it involves increased travelling times, due to the necessity of changing elevators at the sky lobby. As there is a very strong need for reducing the area of the elevator shaft, this has resulted in the introduction of the double-deck elevator to increase the transportation capacity. In this solution, one of the two cars is mounted on top of the other. The elevator stops at every second floor. If the passenger is on the "wrong" floor, he has to get to the floor above or below either before or after the drive, e.g. using an escalator. This system has the drawback of being unpractical and causing extra traffic between even and odd floors, especially in communities covering several floors. In estimating the performance of an elevator group, the following three questions should be considered (see Committee 2A "Vertical and Horizontal Transportation", of the Council of Tall Buildings and Urban Habitat, Part of the Monograph of the Planning and Design of Tall Buildings, chap. SC-4, pages 139–140):

Transportation capacity, expressed as a percentage of the total number of people in the building during the two five-minute periods (morning and afternoon rush hours) during which the elevators are most heavily loaded, Average time interval between the arrivals of elevators at a typical floor level, Longest travelling time in the up direction.

Typical values for these quantities in a first-class office building, according to the same source, are: transportation capacity 11–13%, average interval between arrivals 25–35 s, and max. travelling time 180 s. These values apply for a diversified building accommodating several enterprises. In single-purpose buildings the corresponding values are typically somewhat better.

In the elevator systems used today, the main problems are the waiting times, which may be unduly long during peak traffic, about 2–3 times longer than the average interval between elevator arrivals, which is rather too much particularly for people who have to change elevators in buildings with a sky-lobby. Such waiting times therefore constitute a deterioration of the performance of the elevator system, at least with regard to the last-mentioned criterion. Moreover, it is obvious that a reduction in the waiting times will involve indirect improvements in the performance of the system with regard to other criteria as well. It seems fairly unlikely that any substantial improvements could be achieved in today's elevator systems based on independent group control.

BRIEF SUMMARY OF THE INVENTION

It is an object of the present invention to achieve a decisive improvement in the elevator services in buildings having several elevator groups supplying each other with passengers.

According to the present invention the control of at least some of the elevator groups operating on opposite sides of the change level is subordinated to a centralized control algorithm which, depending on the demands of the traffic, alters the control parameters of the elevator groups in such manner that, when the main direction of traffic is upwards, to serve the passengers arriving from one side of the lobby, either the elevators operating on the other side will arrive quicker at the lobby to minimize the waiting time for the passengers arriving from the opposite side, and/or the departures of the elevators which have stopped at the lobby are retarded to allow the passengers arriving from the other side to get on board, and when the main direction of traffic is downwards, to serve the passengers arriving from one side of the lobby, either the elevators will reach the lobby quicker and/or the elevators on the other side are kept waiting to allow the arriving passengers to catch them.

Thus the invention utilizes in an algorithm designed to coordinate the elevators' arrivals to and departures from the sky lobby so as to minimize the time required for changing elevators. The aim is to minimize the sum of all waiting times for the elevator system of the building.

BRIEF DESCRIPTION OF THE DRAWINGS

Further features, objects and advantages of the present invention will be apparent from the following description of a preferred embodiment thereof, with reference to the accompanying drawings, wherein.

DETAILED DESCRIPTION OF PREFERRED EMBODIMENTS

Figure 1:
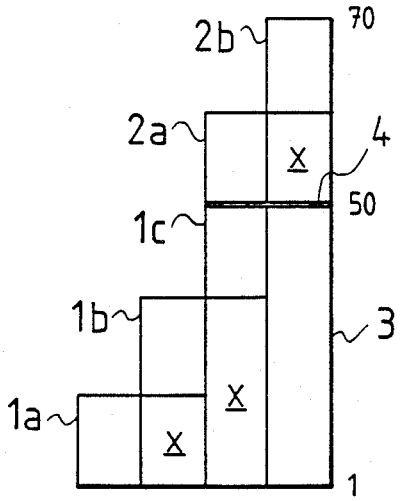
FIG. 1 shows an elevator system commonly used in very tall building.

FIG. 1 shows the elevator system of a 70 story building in a simplified form. Between the floors 1–50, there are 3 groups 1*a*–1*c*, each comprising 4–8 elevators. Each group is assigned a specific service zone, so that the elevators in the group serve their particular zone only. Therefore, for the elevator groups 1*b* and 1*c* serving the higher zones, there are express zones X where these elevators do not stop at all. Regarding the elevator service arrangements, the building has been divided into two parts by means of a change level 4, which is the end station for the elevators leaving from the street level. The story above the change level are served by elevator groups 2*a* and 2*b*, arranged in the same way as groups 1*a*–1*c*. For passengers who need to get from the street level to one of the floors above the change level, the building is provided with another group 3, consisting of 4–8 shuttle elevators which travel between the floors 1 and 50 without stopping at any of the floors in between.

Figure 2A:
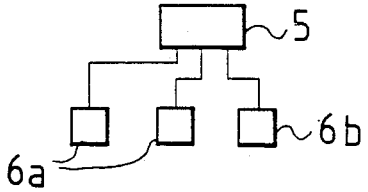
FIG. 2*a* shows an example of the control method according to the present invention for use with an elevator system such as that shown in FIG. 1.
Figure 2B:
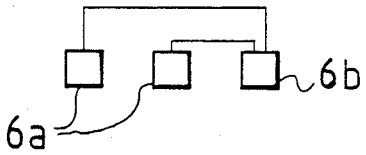
FIG. 2*b* shows another example of the control method according to the present invention for use with an elevator system such as that shown in FIG. 1.

FIGS. 2*a* and 2*b* show different alternatives for implementing the method according to the present invention on the instrument level in the case of a system such as that shown in FIG. 1. When necessary, using a coordination control (Meta Group Control) algorithm, a main computer 5 in FIG. 2*a* assumes control of group control computers 6*a* and 6*b*, which in turn control the elevator groups 2*a*–2*b* and 3 in FIG. 1, using a known method. This coordinating control function is best implemented by means of internal parameter transfers within the system, because this is a quick method and does not involve impairment of the service quality during the transition. The main computer 5 is supplied all the relevant data from the group control computers 6*a* and 6*b* concerning the elevators, e.g. load, position, speed etc. The data are analyzed and, if necessary, the Meta Group Control algorithm in the main computer is enabled to control the elevators working under the group control computers.

FIG. 2*b* presents another arrangement, in which the coordination algorithm MGC is placed in the computer 6*b* controlling the shuttle elevator group. Thus, when necessary, the computer 6*b* will assume control of the group control computers 6*a*, which otherwise operate in a parallel mode.

It is altenatively possible to place the Meta Group Control algorithm in one of the group control computers 6*a*, but this variant is not shown in the drawings as the situation is fully analogous to that shown in FIG. 2*b*.

The computers may be interconnected to each other with serial data transmission links, utilizing any standard. In this case the RS 422 is preferably used, because the driver software needed to control the data transmission is hardware-resident.

Generally, the CPU real time processing load is not increased severely by the MGC algorithm, as the calculation tasks are relatively simple. The frequency of events is also relatively low. Some additional memory space is needed, say 5–10 kbytes, depending on the application. This is within the normal reservations or already existing reserves for future expansions in modern systems. Because of these facts, the integrated alternative according to FIG. 2*b* is possible in small applications without overloading the computers.

Figure 3:
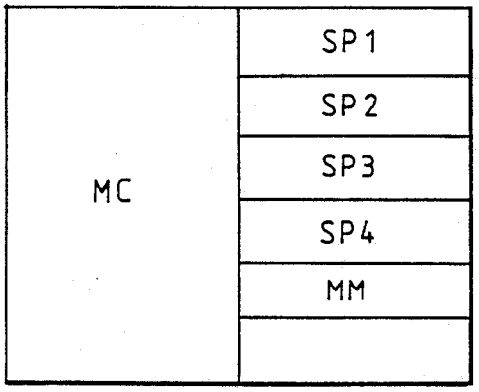
FIG. 3 is a block diagram of a microcomputer, used in the method according to the present invention as a group control computer.

In FIG. 3 there is shown a block diagram of a microcomputer, used in the system according to the invention as a group control computer (6*a* or 6*b* in FIG. 2). The microcomputer of FIG. 3 comprises a mothercard MC containing a group control processor and its main interface adapters, a realtime clock, at least part of the operating system and a required amount of RAM-memory. The card slots SP1–SP4 contain the serial ports, which have the RS 422 configuration and the required software resident on each card. The ports are used for connecting the group control computer to the lift control computers, to locally used trouble-shooting tools, to remote supervision devices, and finally, to the Meta Group Control computer. MM is a mass memory interface card containing another part of the operating system, for access to the statistics facilities used by the system. The empty slot is reserved for future expansions. The system is usually powered by a separate power unit (not shown).

Figure 4:
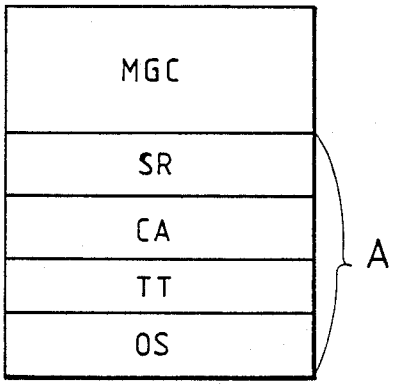
FIG. 4 is a block diagram showing how the algorithm applying the method according to the present invention is incorporated in the normal elevator group control programs.

FIG. 4 is a block diagram showing how the algorithm applying the method of the invention is incorporated in the normal elevator group control programs. In this diagram, letter A refers to the various blocks of a typical group control program, which are SR (Statistics and Reports), CA (Control Algorithm), TT (Test & Troubleshooting aids), and OS (Operating System). According to the invention, an additional block, the coordination control algorithm MGC, is incorporated in the system to control the operation and parameters of these program blocks.

Most modern elevator group control systems use operating system-based software. This is advantageous, because it allows one to use standard software in multitask operations, like using the serial transmission drivers simultaneously for MGC functions. The preferred embodiment of the invention uses an operating system developed for control applications in general. The most essential features include fast intertask communication and extensive task priorization tools, giving the possibility of optimising the limited processing power of a microcomputer for the realtime processing requirements arising from elevator group and elevator control functions. The optimization of several elevator groups is heavily dependent of traffic intensity recognition and traffic type detection. The group control systems must be capable of collecting a sufficient database for refinement and interpretation to ensure reliable traffic state detection. The detection results are in turn used for deciding when a switching of control principles or control algorithm is needed. This is the point where the inventive concept comes into the picture. The hardware and software considerations discussed above are as such well-known facts in the art, and form no part of the present invention, but are included for the sake of clarity. The following context will contain an example of a decision-making process in a control computer that is implementing the method according to the present invention.

Figure 5:
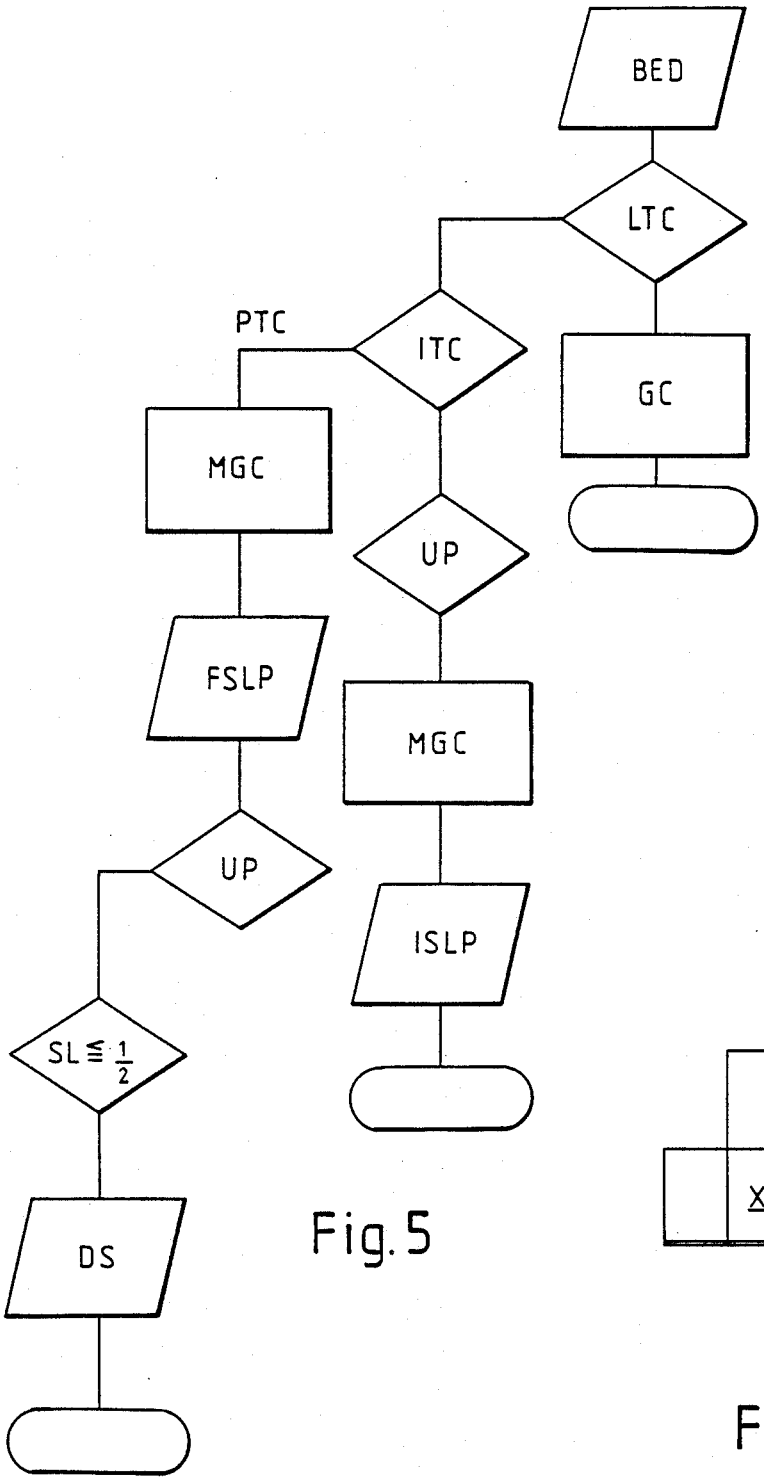
FIG. 5 presents a block diagram showing how the algorithm applying the method according to the present invention is incorporated in the normal elevator group control programs.

FIG. 5 shows a simple example of the decision-making process in the main computer 5. The input quantities are entered in the BED (Basic Elevator Data) block and include information such as the calculated times of arrival of the shuttle cars 3 at the change level 4, the load in elevators 2a,2b at the moment, the number, origin and destination of calls registered for these elevators but not yet served etc. If a test in the LTC (Low Traffic Condition) block indicates that the loading condition of the elevators does not require the engagement of the MGC control algorithm in the main computer, the process will end up in the GC (Group Control) block, i.e. normal group control, under which the elevator groups operate independently and in such manner that a certain number of vacant elevators from groups 2a–2b are parked at the sky lobby.

If the LTC test indicates that the traffic condition exceeds the limits of low traffic, the main computer's control algorithm performs a check in the ITC (Intermediate Traffic Condition) block to see if an intermediate loading condition prevails. If this is the case, the control algorithm then checks whether the main direction of traffic is upwards (block UP). If it is not, the program will proceed, in this example, without changing the group control. For downward traffic, the behaviour of the elevators can easily be optimised within the groups using normal group control. For upward traffic, however, the group control parameters are changed by the main computer's coordination algorithm MGC. In the case of an intermediate traffic condition, the main computer 5 in FIG. 2 will change the control with regard to the control parameters of the group control computers 6 in such manner that the sky lobby 4 on the 50th floor of the building is given increased priority. This is accomplished in the ISLP (Increased Sky Lobby Priority) block, and in this example it means that if, using normal group control GC, a sufficient number of elevators from groups 2a and 2b cannot be brought to the sky lobby at the times when the shuttle cars 3 arrive, the coordination algorithm MGC will retard the departure of upward-bound elevators carrying e.g. half the maximum load or less by a suitable time to allow the passengers from the shuttle cars to catch them.

If the ITC test yields a negative result, this means that a peak traffic condition (PTC) prevails. In that case the coordination algorithm MGC immediately assumes control and gives the sky lobby full priority in the FSLP (Full Sky Lobby Priority) block. This means that the elevators 2a,2b will, whenever required, pass by other floors to which Lhey have been called in the group's internal operation, in order to be able to serve the passengers arriving at the sky lobby with the shuttle cars 3. This is done regardless of the direction of the peak traffic, because in either case the waiting times will be shorter if the elevators operating on opposite sides of the level are simultaneously at the lobby.

For different traffic directions, the coordination control parameters may well vary in the details, depending on the traffic direction and the amount of counter-traffic, but the principle is the same in either case. Internal parameter control provides the advantage that the service quality does not deteriorate during the time when the parameters are being changed.

In the case of downward peak traffic, the algorithm in the example performs an UP test. If the result is negative, it then checks in the SL (Shuttle Load) block if any of the shuttle cars 3 has a load below the maximum, (e.g. half the permitted load). If necessary, shuttle cars with less than a full load can be kept waiting until the supplying elevators 2a,2b arrive at the sky lobby. In that case, the load in the supplying elevators 2a,2b also has to be considered to avoid exceeding the capacity of the waiting shuttle cars. However, for the sake of clarity, this feature is not shown in the figure.

Of course, the elevators have to serve all the other calls during peak traffic as well, observing the maximum waiting times, but this general principle and its applications are already known in the art and form no part of the present invention.

Figure 6:
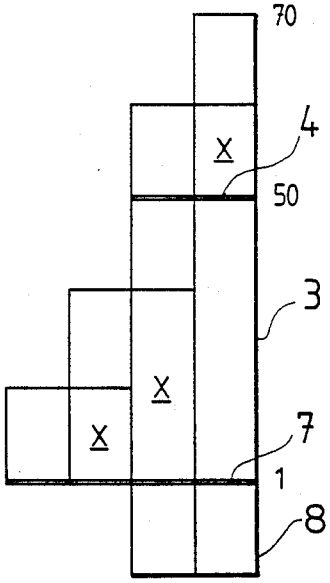
FIG. 6 presents an elevator system in a building with two change levels.

FIG. 6 shows a building with two change levels 4 and 7. The elevator system above the level 7 corresponds to the system of FIG. 1. The elevator groups 8, operating in the underground part of the building, supply the groups 1a–1c and the shuttle cars 3 with passengers e.g. from an underground railway station or car park. These elevators can be controlled along the same principles in coordination with the shuttle cars 3, as shown in FIG. 5, naturally considering the reversed order with regard to the shuttle cars. The coordination algorithm for these groups 8 may be placed either in the same main computer or in a separate one.

It will be obvious to those skilled in the art that the invention is not restricted to the examples discussed above, but that it may instead be varied within the scope of the following claims.

I claim:

1. A method for coordinating elevator group traffic in a building having at least one transfer level constituting an end station for groups of elevators operating above and below said transfer level, comprising the steps of:

controlling at least some of said elevator groups operating above and below said transfer level through a centralized control algorithm;

altering control parameters for the control of said elevator groups in dependence upon traffic conditions and upon whether the main direction of traffic is upwards or downwards, including the steps of causing elevators operating above said transfer level to arrive more quickly at said transfer level and retarding the departure of elevators stopped at said transfer level to accommodate passengers arriving on elevators operating below said transfer level, when said main direction of traffic is upwards, and causing elevators operating above said transfer level to arrive more quickly at said transfer level and retarding the departure of elevators operating below said transfer level when said main direction of traffic is downwards.

2. A method according to claim 1, which includes providing said centralized control algorithm in a separate main computer detached from the rest of a control system for said elevators.

3. A method according to claim 1, which includes providing said centralized control algorithm in a computer controlling shuttle elevators operating below said transfer level.

4. A method according to claim 1, which includes providing said centralized control algorithm in one of a plurality of computers controlling said elevator groups.

5. A method according to claim 1, wherein said step of controlling includes the steps of calculating the times of arrival of said elevators operating below said transfer level at said transfer level and controlling said elevators operating above said transfer level in response to said calculated times.

6. A method according to claim 5, wherein said building has two transfer levels, further including the step of coordinating elevators operating above the higher transfer level and below the lower transfer level with the calculated times of arrival of elevators operating between the two transfer levels.

7. A method according to claim 1, wherein said step of altering control parameters includes the steps of determining whether traffic conditions are at a low, intermediate or peak level, determining whether the main direction of traffic at said intermediate and peaks levels is upwards, controlling said elevators operating above said transfer level to wait for elevators arriving at said transfer level from below when the main direction of traffic is upwards at said intermediate level, and delaying departure from said transfer level of elevators operating below said transfer level when the main traffic direction is downwards at said peak level.

* * * * *